United States Patent [19]

Palchik

[11] 4,290,389

[45] Sep. 22, 1981

[54] ONCE THROUGH SLIDING PRESSURE STEAM GENERATOR

[75] Inventor: David Palchik, Bloomfield, Conn.

[73] Assignee: Combustion Engineering, Inc., Windsor, Conn.

[21] Appl. No.: 77,819

[22] Filed: Sep. 21, 1979

[51] Int. Cl.[3] ..... F22D 7/00

[52] U.S. Cl. ..... 122/406 S; 122/406 ST; 122/1 R; 165/184

[58] Field of Search ..... 122/406 S, 406 ST, 406 B, 122/367 C, 1 B, 1 C; 165/109 R, 109 T, 184; 60/647

[56] References Cited

U.S. PATENT DOCUMENTS

| | | | |
|---|---|---|---|
| 2,895,508 | 7/1959 | Drake | 165/109 T |
| 2,959,014 | 11/1960 | Artsay | 60/647 |
| 3,021,824 | 2/1962 | Profos | 122/406 ST |
| 3,030,292 | 4/1962 | Ritz | 165/184 |
| 3,035,557 | 5/1962 | Litwinoff | 122/406 S |
| 3,212,477 | 10/1965 | Gerber et al. | 122/406 ST |
| 3,219,018 | 11/1965 | Augsburger | 122/406 ST |
| 3,369,526 | 2/1968 | Midtlyng | 122/406 S |
| 3,399,656 | 9/1968 | Strohmeyer et al. | 122/406 S |
| 3,411,300 | 11/1968 | Schuetzenduebel et al. | 122/406 S |
| 3,530,836 | 9/1970 | Caravatti | 122/406 ST |
| 3,789,804 | 2/1974 | Aguet | 122/1 R |
| 4,145,995 | 3/1979 | Kato | 122/1 R |
| 4,194,468 | 3/1980 | Augsburger | 122/406 ST |

*Primary Examiner*—Henry C. Yuen

*Attorney, Agent, or Firm*—Edward L. Kochey, Jr.

[57] ABSTRACT

A once through steam generator (10) for sliding pressure operation from supercritical pressure at high loads into the subcritical range at low loads, having vertical tubes (14) lining the furnace (12) walls and passing their entire length without a mixing header. The furnace tubes are internally rifled and have orifices (47) associated with them to proportion the flow at full load. A steam separator (26) receiving effluent from the tubes sends steam to the superheater (70) and at low ratings returns water (32,40) to the tubes for recirculation therethrough. The tubes (14) are sized in accordance with a specified criteria based on the mass flow rate at full load, or on the ratio of friction drop to static head.

28 Claims, 7 Drawing Figures

ONCE THROUGH SLIDING PRESSURE STEAM GENERATOR

BACKGROUND OF THE INVENTION

The invention relates to once-through steam generators and in particular to supercritical pressure steam generators which operate at subcritical pressure when at low ratings.

Steam power turbo-electric plants can be designed and operated at lower heat rates if they operate at supercritical pressures such as 220 atmospheres. The turbine is designed to pass the full steam flow with the design supercritical pressure at the turbine inlet. The steam generator must, accordingly, be designed to produce steam at supercritical pressure.

In an electric generating plant it is frequently required that the turbine operate at low load, particularly at night and during weekends when electric demand is low. At significantly reduced load where the turbine does not require supercritical pressure, continued operation of the steam generator at the high supercritical pressure actually increases the heat rate. Regardless of the turbine inlet design, there are inherent efficiency losses in such operation. Supercritical pressure steam from the steam generator must be throttled to the appropriate turbine inlet pressure. There is a substantial temperature drop involved in such throttling and, except for the few valve points on certain turbine types, there is a throttling loss. Accordingly, it would be preferred to operate the steam generator itself at a reduced pressure during the reduced load operation.

The high temperature steam turbine cannot tolerate rapid temperature changes. During a restart of the turbine it is important to match the steam temperature to the turbine metal temperature. During rapid load changes the temperature of the steam entering the turbine stages may not change drastically without creating stress damage to the turbine. As load is decreased with constant steam generator outlet temperature and pressure, the turbine valve throttling drop creates a temperature drop in the turbine.

This changing temperature limits the permissible rate of load change. If the steam generator pressure is reduced with load, the throttling pressure drop does not occur. Accordingly, the throttling temperature drop does not occur, thereby removing this limitation on the rate of load change.

For these reasons steam generators have been operated at sliding pressure. This is generally accomplished by maintaining a substantially fixed turbine throttle valve position, and varying load by changing the steam generator pressure.

With all throttle valves wide open, supercritical pressure such as 250 atmospheres, is required at full load. The required pressure decreases approximately linearly with load.

A common form of sliding pressure operation uses full pressure operation from full load down to the first valve point (about 75 to 80 percent load), and full sliding pressure below this load. This maximizes turbine efficiency of partial arc turbines, and provides energy storage for improved control response.

One of the problems, where such operation encompasses both supercritical and subcritical pressures, relates to an inherent difference in the behavior of water at supercritical and subcritical pressures. At subcritical pressures a two-phase mixture occurs in the combination of water and steam at the same temperature. At supercritical pressure the change from water to steam is gradual and uniform with no two-phase phenomenon occurring. This has created conflicting requirements on pressure part design, particularly in furnace wall circuits.

The two-phase subcritical pressure operation has the advantage that low enthalpy water may be separated from high enthalpy steam with the water being sent back for recirculation through the waterwalls. This ability to separate, however, is a problem when a two-phase mixture must be passed from one group of tubes to another, with the probability of a poor distribution of water and steam entering the circuits of the succeeding group.

Once-through boilers have been operated in the subcritical mode with a slight amount of water leaving the waterwalls. This water is then discharged back to the feedwater system. Some have been operated such that full evaporation occurs in the waterwalls and only dry steam leaves the waterwalls.

At full load operation a particular heat distribution pattern occurs in the furnace which is a function of the firing equipment used and the slagging pattern occurring on the walls. This heat absorption pattern may be predicted with reasonable accuracy. At low load operation, however, the heat distribution pattern of the same unit changes. Accordingly, designing for a predicted heat distribution at full load can create temperature maldistribution problems at low loads.

Temperature maldistribution problems show up in the steam generator as excessive temperature levels in particular tubes which are receiving heat out of proportion to the amount of flow allocated to them. They also produce excessive stresses caused by large temperature differences between various tubes in the furnace wall structure.

Several methods have been used in the past to meet this problem. The furnace wall tubes have been arranged in a spiral configuration so that they pass angularly around the entire periphery of the furnace to achieve an equalized heat absorption. This results in difficult construction problems, particularly with wall support and burner openings.

Multiple passes of fluid through the furnace wall tubes in series has been used to decrease the amount of heat absorbed in each path and, accordingly to limit the temperature unbalance occurring in each pass. This produces an arrangement with multiple downcomers which is also difficult to construct and which creates problems in distributing a two-phase mixture between the various passes.

Another approach has been to introduce mixing headers at one or more locations throughout the furnace height so that the water passing therethrough is mixed to an average heat content before entering the next section, thereby reducing temperature unbalance. This also is an expensive arrangement, and the problem of distributing a two-phase mixture continues.

The furnace wall tubes face furnace temperature on the outside and the fluid temperature on the inside. The actual tube wall metal temperature is a function of the heat transfer rate between the tube metal and the fluid passing through the tube. This heat transfer rate is generally a function of the mass flow rate of the fluid and is excellent when nucleate boiling occurs. It is good for supercritical fluid. When film boiling occurs in a plain tube, the transfer rate is very poor. It is known that internal flow disturbers such as internally ribbed tubing greatly improves this heat transfer rate where film boiling occurs.

During initial start-up of a steam generator, it is required that there be some flow through the furnace wall tubes. This is required to provide uniform heating of the structure and also to provide sufficient heat transfer at local points in the tube to avoid local overheating. On drum-type units recirculation is always used for this purpose. On once-through type steam generators a minimum flow may be provided (usually in the order of 30 percent of full load flow) with any excess beyond that which is changed to steam being passed back to the feedwater train. Another approach has been to use pumped recirculation of water through the tubes of the furnace.

The desirability of sliding pressure operation has long been known. The simplicity of fabrication and construction of a furnace structure using vertical tubes, without mixing of headers, or multiple passes is clearly desirable. Still, sliding pressure once-through units for supercritical operation have employed the complex furnace tubing arrangements.

SUMMARY OF THE INVENTION

A supercritical pressure once-through steam generator, for sliding pressure operation into the subcritical pressure range at reduced loads, has vertical tubes lining the walls of the furnace and extending the full height thereof. The tubes have internal flow agitating means such as internal rifling throughout substantially the entire heated length. All tubes are in parallel flow relationship, and orifices are provided to apportion the flow through the various vertical tubes in accordance with the full load predicted heat absorption.

A steam water separator receives the effluent from the waterwall tubes, and a pump operates to recirculate the water from this separator through the furnace wall tubes. The pump is sized to recirculate less than 50 percent of the full load flow of the unit.

The tubes and tube spacing of the waterwalls are sized such that the mass flow load is less than $d+5$ divided by 0.0125 where d represents the inside diameter of the tubing measured in millimeters and w is the mass flow rate through the tubes at full load measured in kilograms per second per meter squared. This permits operation down to about 30 percent of full load without pumped recirculation.

Alternatively, the frictional pressure drop through the vertical furnace wall tubes at full load is less than four times the static head of the fluid existing in these tubes at full load.

The internal rifling of the furnace wall tubes has very little, if any, function when the unit is operating at supercritical pressures. It, however, permits adequate cooling of the furnace wall tubes by the water flowing through them by increasing the heat transfer rate during film boiling at subcritical operations. This permits the use of lower mass flow rates through the tubes at subcritical pressure operation than would otherwise be possible.

The orifice selection is made to apportion the flow in accordance with heat absorption at high load on the steam generator. At reduced ratings, the heat distribution in the furnace changes, and the selection of flow established by the orifice selection is inadequate. The defined selection of mass flow, tube size and/or pressure drop relationship at full load, however, results in a system wherein at reduced load the orifice becomes relatively ineffective, and a natural-circulation type effect takes place, thereby permitting the unit to adapt to the different heat absorption pattern.

DESCRIPTION OF THE PREFERRED EMBODIMENT

Figure 3:
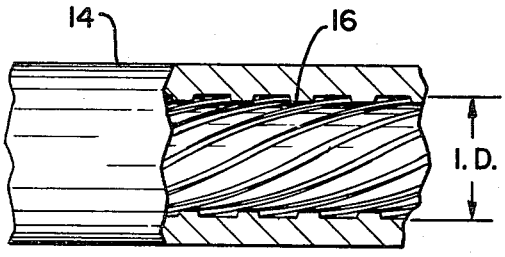
FIG. 3 is a section through one of the rifled furnace wall tubes.
Figure 2:
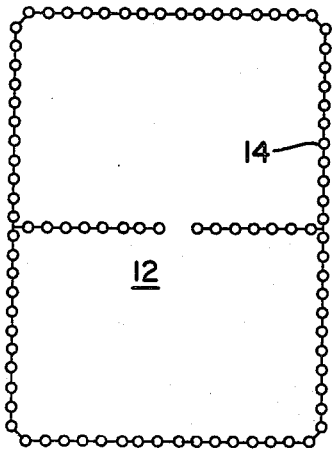
FIG. 2 is a plan view through the furnace at section 2—2 of FIG. 1.

The steam generator 10 includes a furnace 12 having its walls lined with vertical tubes 14 and including fuel firing means 11. These tubes have internal rifling 16 as illustrated in FIG. 3 and an internal diameter id which represents the diameter at the root of the rifling. A typical tube has an OD of 25.5 mm and an id of 15.3 mm. The rifling ribs are 3.2 mm wide and 0.5 mm high with a 30° lead angle.

These tubes extend in a single path throughout the height of the furnace 12. Feedwater entering through header 18 passes through economizer 20 and is conveyed by feedwater supply line 22 to a mixing header 24. During subcritical recirculating operation, recirculated boiler water also passes from separator 26 through downcomer 28 and check valve 30 to the mixing header 24.

This mixture passes through the mixed flow downcomer 32 and, during the pumped recirculation period, through pump 34 and its associated suction valve 36 and discharge valve 38. The water flow passes through discharge line 40 to distribution manifold 42. The waterwall inlet headers 44 through 46 are connected to the lower end of the furnace wall tubes 14. Orifices 47 are clamped to the inlet of each furnace wall tube 14. Each header is divided by diaphragms 48 into a plurality of chambers 50 each of which is supplied by at least one supply line 52. Orifices 54 may be located at the inlet of each supply line; and in combination with orifices 47, they are sized so that the flow passing through each tube at full load is in proportion to the predicted heat absorption of that tube.

The orifices are considered fixed means for apportioning flow, since they are not changed or modulated during day-to-day operation. They may, of course, be changed during a shutdown to correct any misallocation of full load flow. Alternately, valves could be used which are adjusted under test at full load and then left in a fixed position.

The fluid leaving the waterwall tubes 14 is collected in waterwall outlet headers 56 through 58 and passes through risers 60 to the steam water separator 26. Here, any water existing may be separated and returned for recirculation or discharge. Steam passes through the steam outlet tubes 62 where by various flow paths it passes through the tubes 64 comprising the roof of the steam generator, and tubes 66 comprising the walls of the rear gas pass of the steam generator. The steam thereafter passes through superheater panel 68 and the finishing superheater section 70 through connecting links (not shown) and then passes to the steam turbine through a main steam line (not shown).

Reheat steam from the turbine passes serially through low temperature reheater 72 and high temperature reheater 74, thereafter returning to the steam turbine. The connecting links and steam leads are not shown.

When the circulating pump 34 is not energized, only feedwater flow from line 22 passes through the downcomer 32. The flow may be passed through the pump, or bypassed around it through bypass line 80 and stop check valve 82.

Figure 4:
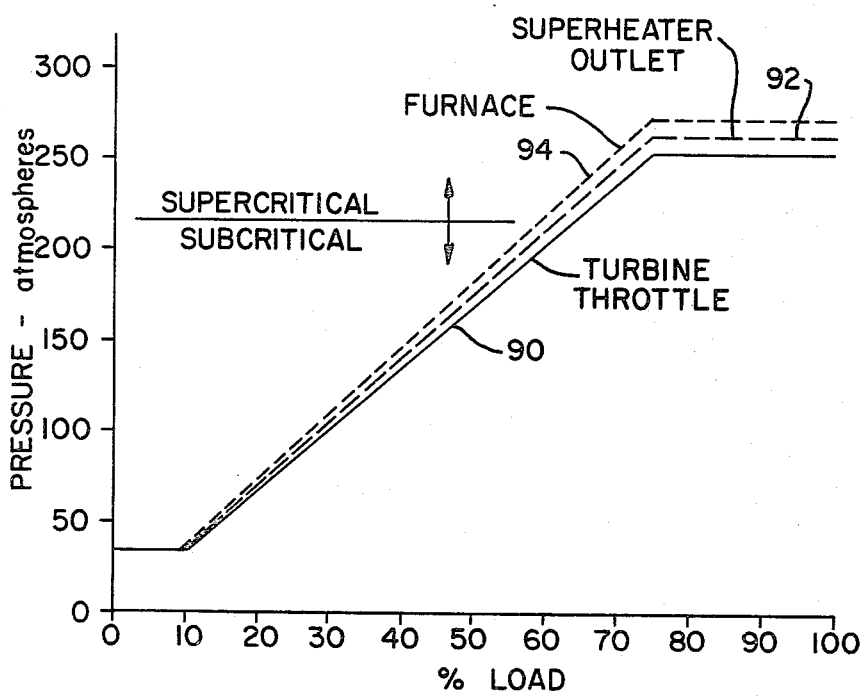
FIG. 4 is a plot illustrating the pressure versus load operating conditions of the unit.

FIG. 4 illustrates the pressure level operation of the steam generator across its load range in accordance with the conventional sliding pressure operation of a supercritical unit. Curve 90 represents the pressure existing at the turbine throttle, 92 represents the pressure existing at the superheater outlet, and 94 represents the pressure existing at the furnace wall outlet. The difference between the various curves represents the pressure drop through the piping system. Further references to pressure will relate to that at the furnace wall outlet with it being understood that the other pressures will be slightly lower, the amount depending on the flow and specific volume of the steam passing through the lines.

It is noted that there is a constant pressure portion near the full load operation point. It is a matter of choice as to whether one operates at constant pressure in this range or not. The constant pressure range is frequently in the order from 75 percent of full load to full load. One may, if desired, slide pressure over the entire load range from minimum load to 100 percent load. The use of the flat portion, however, represents at least a partial closing of one of the turbine throttle valves; and the break point usually selected on a partial arc admission turbine is in the fully closed position of the first valve. This maximizes the turbine efficiency and also provides some energy storage in the boiler so that in the event of a demand for a load increase the valve may be opened to obtain an immediate response. In any event it can be seen that in the load range between 30 and 50 percent the furnace wall pressure is in the order of 80 to 140 atmospheres.

During start-up and at extremely low load operation the unit operates at subcritical pressure with recirculation. Feedwater entering through economizer 20 is controlled to maintain a water level 84 in the drum 26. The water mixes with recirculating flow in header 24 passing through circulating pump 34 and upwardly through tubes 14 of the furnace wall. The steam-water mixture leaves the furnace wall tubes and is conveyed to the drum 26 with all of the unevaporated water being recirculated.

During normal low load operation the unit operates as a subcritical once-through system. Feedwater entering through economizer 20 passes either through or around circulating pump 34 and upwardly through the furnace wall tubes 14. The flow is controlled to obtain slightly superheated steam leaving the furnace wall tubes which passes to the separator 26 and on through the superheaters. Should any water inadvertently be discharged to the separator, it is removed through a blowdown line 86 to a convenient location in the feedwater train.

During this operation the fluid within the furnace wall tubes varies from subcooled water at the inlet to saturated water, and then through the entire evaporating range to dry steam, followed by a slight amount of superheating. It can be seen that at this time a portion of the evaporation occurs in the presence of very high quality steam where departure from nucleate boiling is likely to occur. It is in this range that the internal flow disturbers such as interior rifling on the tubes is effective to promote reasonable heat transfer at relatively low mass flow rates.

The rifling extends throughout substantially the entire heated length of the tubes 14. It may be omitted at the lower portion of the tubes where only subcooled water and low quality steam occur. When the heat absorption rate at the upper portion of the tubes is always low at the same time high quality steam is present, the rifling may also be omitted near the top.

During high ratings the unit operates at supercritical pressure in the once-through mode. The flowpath is identical with that described in the subcritical once-through mode. Since there is no water-steam separation possible in the separator 26, the blowdown line 86 is not used at this time. During this time the furnace wall tubes contain only supercritical fluid being heated to a temperature level of approximately 425° C.

During low load subcritical operation there is a range over which the unit may be operated either with or without pumped recirculation. This avoids the problem of starting and stopping recirculation on minor load changes that occur in this range.

A 700 megawatt coal burning steam generator was designed for a full load steam output of $2.3\times10^6$ kilograms per hour. The furnace size selection based on fuel burning requirements resulted in a furnace 26.2 meters deep and 13.1 meters wide with a centerwall dividing two halves of the furnace. Tubes of 25.5 millimeters OD were selected with a center-to-center spacing of 41.3 millimeters. This resulted in 1900 tubes around the periphery of the furnace in addition to 184 tubes of 38 millimeters outside diameter forming the centerwall. The centerwall and all of the outer furnace walls of the unit are in parallel flow relationship resulting in a single pass of the fluid up through the furnace walls.

The outer wall tubes were of 45.7 millimeters minimum wall thickness resulting in a nominal inside diameter of 15.3 millimeters. The centerwall tubes were selected with a 7.16 millimeter minimum wall thickness resulting in a 22.35 millimeter nominal inside diameter.

At full load and at supercritical pressure the inlet temperature to the waterwalls was 349° C., and the average outlet temperature was 415° C. Specific volume of the fluid varied from $1.6\times10^{-3}$ meters squared per kilogram at the inlet to $6.2\times10^{-3}$ meters squared per kilogram at the outlet. Because of the various configurations of the front, side and rear wall tubes, the pressure drop of the tube itself varied from 235 kilopascals to 509 kilopascals. Corresponding static heads in each of the circuits varied from 205 to 196 kilopascals. The orifices 54 were selected to provide a distribution of flow to the various tubes in proportion to the predicted heat absorption of these tubes. The total pressure drop from the distribution manifold 42 to the separator 26 was 1310 kilopascals.

This selection was then investigated at approximately 30 percent of full load at a pressure of 104 atmospheres. The investigation was made without the circulating pump operating so that the unit was operating in the pure once-through flow condition.

Entering the waterwall tubes, the water was 293° C. which was 22° C. below saturation temperature. The specific volume was $1.3\times10^{-3}$ cubic meters per kilogram. The average outlet condition was 329° C., and the average specific volume was $14.4\times10^{-3}$ cubic meters per kilogram.

The investigation at reduced load involved an initial determination of the fluid flows and temperatures occurring with the predicted low load heat absorption distribution. This was followed by calculations based on possible deviations from the predicted absorptions.

A discussion of the behavior of parallel heated flow paths, with significant specific volume change, is required. While the sum total of flow passing through the furnace wall tubes 14 must equal the through flow, the distribution of flow among the various tubes is of concern. Only the circuits from manifold 42 through the supply lines 52, furnace wall headers, furnace wall tubes 14 and relief lines 60 to separator 26 need be considered.

All of the furnace wall tubes are arranged in parallel flow relationship. Accordingly, the pressure drop across each of the tube circuits between common points (manifold 42 and separator 26) must inherently be exactly the same. This pressure drop is formed of two components. There is a frictional pressure drop and a static head pressure drop.

The total pressure drop between manifold 42 and separator 26 may be considered in three sections. The initial section from manifold 42 to header 45, and through orifice 47, experiences a constant specific volume at a given operating condition. Friction in this section, therefore, varies only as the square of the flow while the static head is constant. Once this constant static head is subtracted, the entire section (which includes the orifices) may be considered or represented as a single orifice, associated with its corresponding furnace wall tube, or group of tubes. This pressure drop becomes small at low load, as discussed below.

The final section from furnace wall tube outlet header 57 to the separator 26 experiences the specific volume of the mixed fluid leaving the various furnace wall tubes 14. Tubes 60 conveying the fluid are normally liberally sized, and because of the high specific volume, static head is small. The friction drop in this section may be neglected to simplify the discussion.

Within the heated circuit 14, from inlet header 45 to outlet header 57 the occurrences are more complex because of the change in specific volume as the flow in each of the heated tubes varies. The frictional pressure drop component of the total pressure drop is a function of the square of the weight flow, the specific volume and the reciprocal of the inside diameter of the tube. The second component of the pressure drop is the static head of the fluid within the tube which is a function of the elevation difference and the reciprocal of the specific volume. Each of these factors, of course, must be integrated throughout the length of the tube.

The phenomenon which is occurring can best be understood by visualizing the occurrences on a single heated tube which is operating in parallel with other heated tubes. The friction and static head components of the pressure drop can be analyzed independently and then combined.

Conceptually flow is held constant in a particular tube and a change in heat absorption assumed. The resultant change in specific volume results in either an increase or decrease in the pressure drop. Since the tube is in parallel with all the others the total pressure drop must remain constant. Therefore, the flow must increase or decrease to place the circuit in equilibrium. In actual calculation, the additional change in specific volume caused by the flow change must also be considered.

This single heated tube now has a preselected inside diameter with fluid entering at a low specific volume and leaving at a high specific volume as a result of the heat absorption occurring throughout the length of the tube. The item of concern is the effect on flow and outlet temperature of a change in heat absorption to this particular tube because of a change in distribution of heat within the furnace. If we first assume a 20 percent increase in heat absorption, this results in a 20 percent increase in enthalpy rise throughout the length of the tube and a resultant temperature and specific volume increase. Looking at the friction component, this increase in specific volume tends to increase the frictional pressure drop, and accordingly, this would tend to decrease the flow in order to place the circuit in an equilibrium condition. Looking at the static head component, on the other hand, this same increase in specific volume tends to reduce the pressure drop component due to the static head, and therefore, there is a tendency for the flow to increase in order to place the circuit into equilibrium. For convenience a situation where an increased heat absorption results in an increased flow will be termed a natural circulation characteristic, while a situation where an increased heat absorption results in a decreased flow will be termed a forced flow characteristic. In an upwardly flowing heated circuit the net effect on flow of an increased heat absorption depends on whether the natural circulation characteristic or the forced flow characteristic predominates. The 20 percent increase in heat absorption discussed above results in a 20 percent in enthalpy rise and the resultant temperature increase where there is no change in flow. This temperature increase is aggravated where there is a forced flow characteristic and a decrease in flow, while it is diminished when there is a natural circulation characteristic and an increase in flow.

A forced flow characteristic tends to be produced when there is a high flow rate, a small internal diameter and a circuit which is long in relation to its height. The tendency for a forced flow characteristic increases when there is a high frictional pressure drop in relation to the static head differential across a circuit.

Orifices associated with the circuit cannot change a flow decrease into a flow increase, but merely operate to minimize the amount of change in flow in either direction. This occurs since on a decrease of flow through the circuit, the flow also decreases through the orifice to that particular circuit. Therefore, the orifice pressure drop decreases and this change in orifice pressure drop now becomes available for producing flow through the heated tube portion of the circuit. Total pressure drop across the circuit remains the same since we are investigating a particular tube or group of tubes located in parallel with a large number of tubes which in effect fix the overall pressure drop.

As the unit operates between the supercritical pressure range and a low pressure subcritical range, the specific volume of the fluid (subcooled water) entering the furnace wall tubes changes a relatively small amount. Accordingly, the decreased flow rate causes a substantial decrease in pressure drop through the supply tubes and orifices since it is in proportion to the square of the flow rate.

On the other hand, the pressure drop in the tube and the static head variation effects in the heated circuit remain substantially high since the specific volume of the subcritical steam being formed in the tubes is quite high. It follows that the effect of the orifice with respect to the tube tends to disappear at these subcritical low load ratings. By selecting a tube in conjunction with the full load mass flow rate such that the natural characteristics occur at reduced loads, it is possible to operate the described unit satisfactorily at these loads and at subcritical pressure without recirculation. This unique selection permits natural circulation effects to take over at the reduced loading, thereby precluding the need for spiral wound walls, mixing headers or multiple passes through the waterwall.

Investigations were performed at 27 percent of full load at a pressure level of 104 atmospheres. An alternate selection to that described above involved a 22.2 millimeter outside diameter tube having an inside diameter of 12.2 millimeters. The mass flow rate at full load was $2.336\times10^3$ kilograms per second per meter squared. The circuit at the reduced rating had an inlet temperature of 239° C. and an inlet enthalpy of 312 kilocalories per kilogram. The nominal outlet enthalpy was 671 kilocalories per kilogram, and the nominal outlet temperature was 329° C. A 20 percent heat absorption increase to this circuit resulted in a flow decrease to 92 percent of the original value. The corresponding outlet temperature rose to 520° C. A 30 percent increase in heat absorption resulted in a flow decrease to 82 percent of the original value and an outlet temperature of 815° C.

The earlier discussed selection of 25.5 millimeter OD tube was considered with its mass flow at full load of 1.489 kilograms per second per meter squared. This circuit, of course, had the same nominal inlet and outlet conditions. An increase in heat absorption of 20 percent resulted in a flow increase of 2 percent and an outlet temperature of 375° F. An increased heat absorption of 30 percent also resulted in a flow increase of 2 percent and an outlet temperature of 415° C.

The smaller tube is unsatisfactory for operation at this low load because not only the temperature level but the temperature differences between various tubes exceed that for which one can reasonably design. On the other hand, the larger selected tube results in an acceptable temperature limit. In order to define the structure required to obtain this desired result of allocated flow distribution at full load and a natural circulation characteristic at low load, further investigation was made. With the relatively standardized sliding pressure characteristic with regard to pressure level versus flow, there is a specific relationship between the specific volumes which are occurring at the low loads and those which occur at the full design condition. The flow rate, of course, is in proportion to the actual load on the unit. Accordingly, the design characteristics may be defined as a full load design condition. Obviously if one desires to design for a high load which is slightly below full load (with assurance that distribution is still appropriate at full load) this could be selected for the actual design point.

Figure 5:
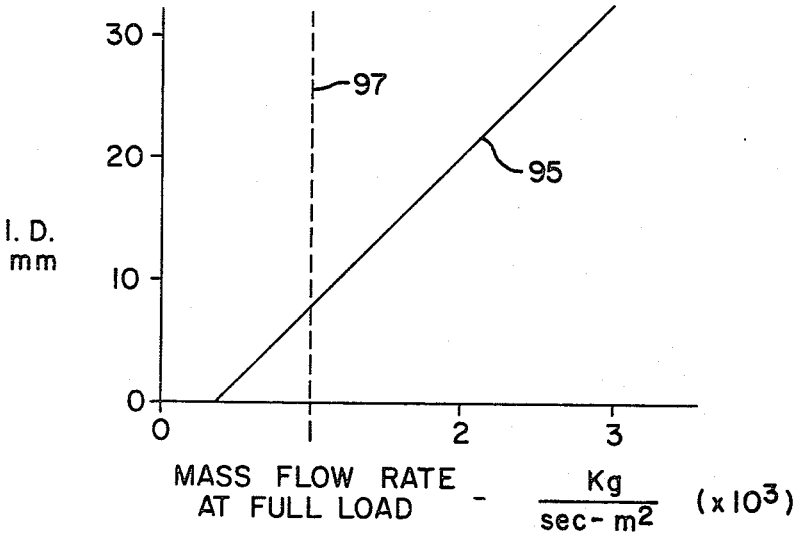
FIG. 5 is a curve illustrating the limits on tube size selection.

It was found that where the frictional pressure drop through the heated circuit did not exceed four times the static head in that circuit, the tube retained appropriate natural circulation characteristics at the approximately 30 percent reduced rating. Furthermore, if one assumes a tube layout which has been generally uniform for the type steam generator using vertical tubes running up the furnace walls, the requirement to obtain the appropriate characteristic may be defined in terms of the inside diameter and the mass flow rate through the tubes at full load. This study resulted in a curve illustrated in FIG. 5 where the curve 95 represents the equation id equals $12.5\ w\times10^{-3}$ minus 5 where id is in millimeters and w is in kilograms per second per meter squared. For any given mass flow rate measured at full load in the steam generator, the curve 95 represents the minimum inside diameter which is acceptable and which will produce an acceptable natural circulation characteristic at the approximately 30 percent reduced rating. Selections above this line are acceptable.

A minimum mass flow rate indicated by line 97, at 1000 kilograms per second per meter squared, represents the minimum mass flow rate which should be selected. Selections below this rate while still producing the desired natural flow characteristic result in mass flow rates at low loads which appear to be inadequate even in the presence of tube rifling. Selections below this level should be used only when it is contemplated that the circulating pump will be operated at all times for the very low ratings.

It is preferable that the steam generator have the capability to operate safely at a low load, such as 30 percent without pumped recirculation. This minimizes the pump size, and avoids power consumption by the pump. It also permits sliding from full load to 30 percent load without the need to establish a water level or to start the pumps. Selection outside the range of criteria set forth is expected to require recirculation to a higher load to avoid temperature unbalance problems.

Figure 1:
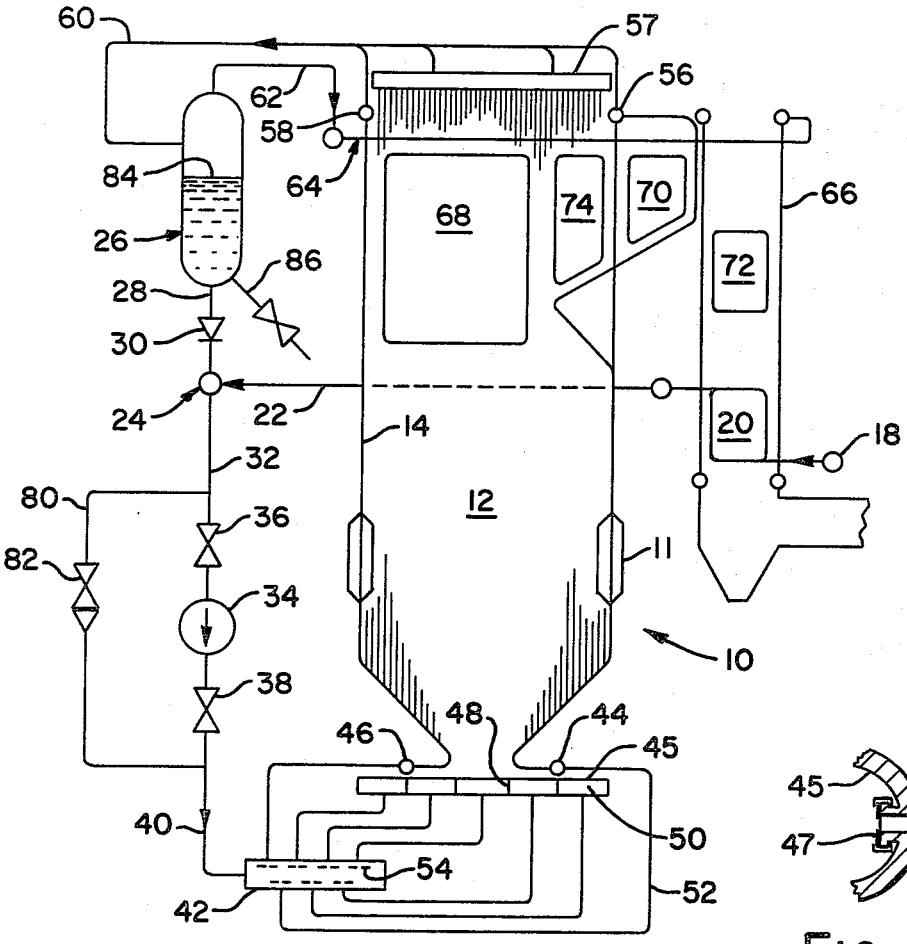
FIG. 1 is a schematic elevation illustrating the general arrangement of the steam generator.
Figure 7:
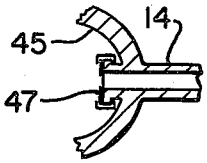
FIG. 7 illustrates the orifices in the furnace wall inlet headers.
Figure 6:
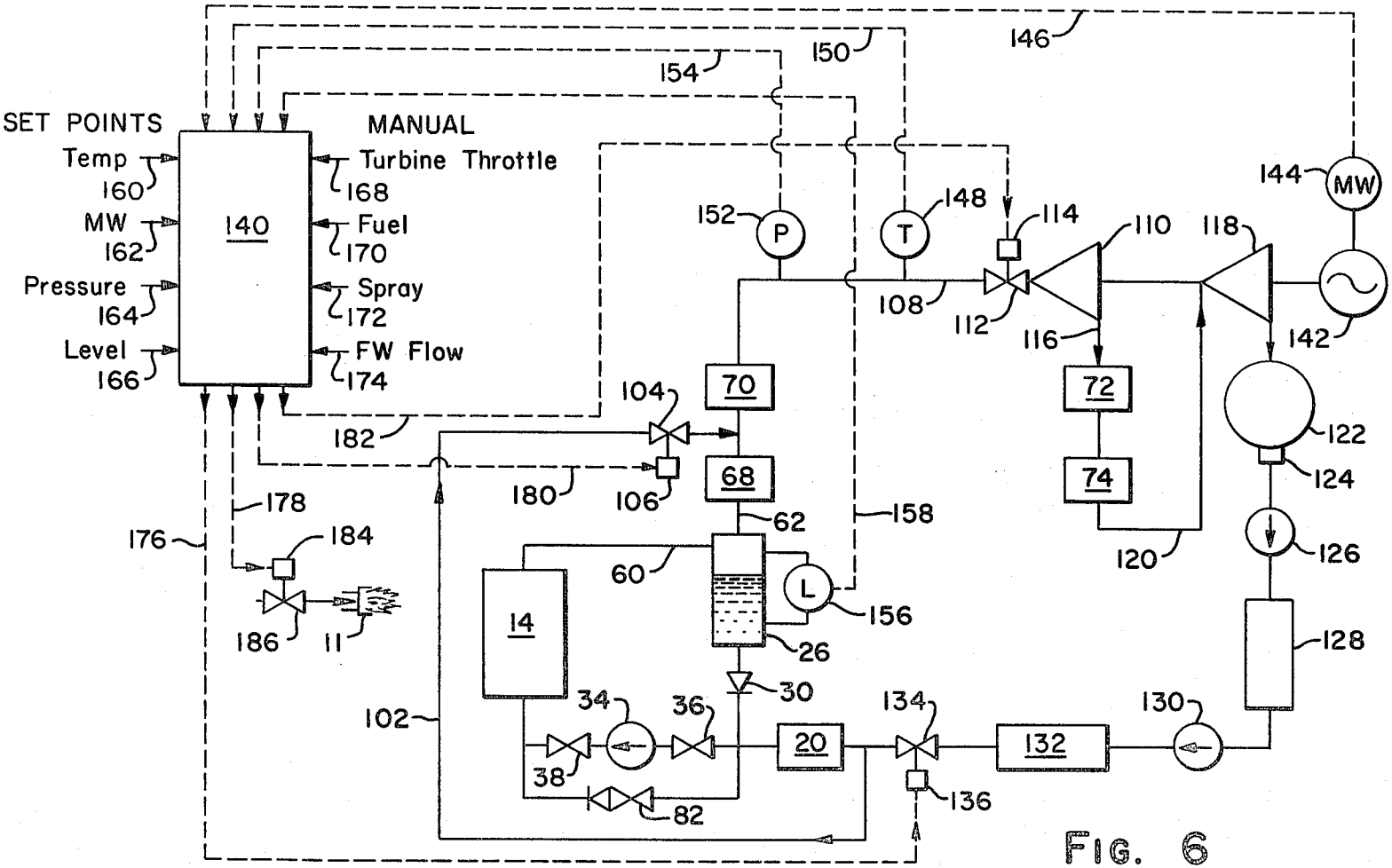
FIG. 6 is a schematic of the cycle with controls.

FIG. 6 is a simplified schematic of the plant cycle with a control schematic included. In addition to the components described with reference to FIG. 1 there is shown a superheat spray injection line 102 including a spray control valve 104 with with its actuator 106. This spray line is used to control steam temperature when there is a water level in the separator 26 and may be used to decrease temperature response time during other periods of operation.

A main steam line 108 carries steam from the steam generator to the high pressure turbine 110. A turbine throttle valve 112 is included with its actuator 114. Steam from the high pressure turbine flows to the reheater 72 through cold reheat line 116 and returns to the low pressure turbine 118 through hot reheat line 120. Steam from the low pressure turbine is condensed in condenser 122, and the water is removed from hot well 124 by condensate pump 126. After passing through low pressure heaters 128 it is raised to a high pressure level by feed pump 130 and passes through high pressure heaters 132. Feedwater flow to the steam generator is regulated by feedwater valve 134 with its actuator 136.

Modern control systems for steam generators are usually of the integrated type wherein a plurality of plant cycle inputs are varied to control each of the plurality of outputs. While it is possible to control each one of the outputs by regulating a particular input, the response time of such a control system is inadequate. Accordingly, control system logic 140 may be of any conventional type.

Electric generator 142 is directly connected to the steam turbines with its output being monitored by megawatt sensor 144. A control signal representing the megawatt output is sent through control line 146 to control logic 140. In a similar manner temperature in the main steam line is sensed through temperature sensor 148 with a signal being sent through line 150. Pressure in the main steam line is sensed through pressure sensor 152 with a signal representing that pressure passing through control line 154.

When a water level exists in separator 26 a signal is sent from water level indicator 156 through control line 158 which represents the sensed water level. Other control variables such as reheat steam temperature or an intermediate steam temperature may also be included within the control system.

For automatic control of the steam generator set points are provided representing the desired values for temperature 160, megawatts 162, pressure 164 and water level 166. Each of these signals represents a desired output to be controlled.

In order to permit full or partial manual control, input signals are provided for the turbine throttle 168, fuel flow 170, injection spray 172 and feedwater flow 174.

Regardless of the logic included within the control system logic 140, control signal outputs pass through control lines 176 through 182. The signal through control line 176 represents the desired feedwater flow and passes to controller 136 which controls feedwater valve 134. The control signal through control line 178 passes to controller 184 which actuates a fuel regulating apparatus 186, which may be a feeder to a coal pulverizer. This regulates the amount of fuel fired through burner 11 into the furnace.

The control signal through control line 180 represents the desired superheater injection flow and passes to controller 106 which actuates spray injection valve 104. The control signal passing through control line 182 passes to the turbine throttle valve controller 114 and operates to vary the opening of turbine throttle valve 112.

In order to obtain the desired variable pressure operation, the pressure level set point is programmed with respect to the megawatts to obtain a variable pressure level across the load range as illustrated in FIG. 4. Various combinations of the control signals and the inclusion of derivative and integral action in accordance with normal steam generator control practice may be used.

The defined selection of flow rate, tube size and pressure drop at full load provides a unit wherein the natural circulation characteristic occurring at low load avoids unacceptable temperature deviations. Accordingly, the prior art approaches of spiral wound walls, mixing headers and multiple passes are not required and the simplified design of passing tubes vertically through the walls on one pass is possible. This, however, requires the use of relatively low mass flows; and the internal flow disturbing means make it possible to tolerate these low mass flows at the reduced ratings where subcritical operation is encountered. The circulating pump provides a means for circulating water through the furnace walls during start-up, and the pump may be operated at reduced ratings as desired to obtain an increased tolerance against tube overheating.

The orifices have been illustrated as located in a manifold supplying a group of tubes, in addition to orifices placed at the entrance to the individual tubes. Orifices at the tube inlet are superior from the flow regulation aspect and are to be preferred. This location at the inlet of the individual tubes may result in selections of orifices with openings so small that they are susceptible to plugging.

I claim:

1. A supercritical pressure once-through type steam generator for sliding pressure operation into the subcritical pressure range at reduced loads, comprising: control means for operating said steam generator at supercritical pressure at high loads and at subcritical pressure at low loads; a furnace; vertical tubes lining the walls of said furnace around the periphery thereof, said tubes in parallel flow arrangement and continuous throughout the height of said furnace; internal flow agitating means located within said tubes throughout substantially the entire heated length thereof; a steam-water separating means; means for conveying fluid leaving said tubes to said separating means; a superheater; means for conveying steam from said separating means to said superheater; means for selectively directing substantially the entire flow of fluid leaving said tubes through said superheater; feedwater supply means; means for conveying feedwater to said tubes; means for passing a flow through said tubes exceeding the flow through said superheater during very low load operation of said steam generator; and fixed means for apportioning flow to various of said vertical tubes in proportion to the predicted full load heat absorption of the various tubes.

2. An apparatus as in claim 1 wherein said means for passing a flow comprises: means for conveying water from said steam separating means to said tubes; and pump means for recirculating water from said separating means through said tubes at low loads.

3. An apparatus as in claim 2: wherein said pump is sized to recirculate less than 50 percent of the full load flow.

4. An apparatus as in claim 3: wherein said pump is sized to recirculate less than 30 percent of the full load flow.

5. An apparatus as in claim 1: wherein said internal flow agitating means comprises internal rifling within said vertical tubes.

6. An apparatus as in claim 1: wherein said fixed means comprises orifices arranged to throttle the flow entering said vertical tubes.

7. An apparatus as in claim 2: wherein said internal flow agitating means comprises internal rifling within said vertical tubes.

8. An apparatus as in claim 7: wherein said fixed means comprises orifices arranged to throttle the flow entering said vertical tubes.

9. An apparatus as in claim 8: wherein said pump is sized to recirculate less than 50 percent of the full load flow.

10. An apparatus as in claim 9: wherein said pump is sized to recirculate less than 30 percent of the full load flow.

11. An apparatus as in claim 2: wherein said fixed means comprises orifices arranged to throttle the flow entering said vertical tubes.

12. An apparatus as in claim 11: wherein said pump is sized to recirculate less than 50 percent of the full load flow.

13. A supercritical pressure once-through type steam generator for sliding pressure operation into the subcritical pressure range at reduced loads, comprising: control means for operating said steam generator at supercritical pressure at high loads and at subcritical pressure at low loads; a furnace; vertical tubes lining the walls of said furnace around the periphery thereof, said tubes in parallel flow arrangement and continuous throughout the height of said furnace, and internally rifled throughout a substantial heated length; a steam-water separator; means for conveying fluid leaving said tubes to said separator; a superheater; means for conveying steam from said separator to said superheater; means for selectively directing substantially the entire flow of fluid leaving said tubes through said superheater; feedwater supply means; means for conveying feedwater to said tubes; means for conveying water from said separator to said tubes; pump means for recirculating water through said tubes from said separator during very low load operation of said steam generator; and orifices for apportioning flow to various of said vertical tubes in proportion to the predicted full load heat absorption of the various tubes.

14. An apparatus as in claim 13: wherein said pump is sized to recirculate less than 50 percent of the full load flow.

15. An apparatus as in claim 1: wherein the tube spacing and sizing is selected such that the mass flow entering said vertical tubes at full load is greater than 1,000 kilograms per second per meter squared.

16. An apparatus as in claim 10: wherein the tube spacing and sizing is selected such that the mass flow entering said vertical tubes at full load is greater than 1,000 kilograms per second per meter squared.

17. An apparatus as in any one of claims 1–16: wherein the size and spacing of said vertical tubes is selected such that the mass flow of water entering said tubes at full load and measured in kilograms per second per meter squared is less than d+5 divided by 0.0125 where d is the inside diameter of the tube measured in millimeters.

18. An apparatus as in claim 1 or 10: wherein the sizing and spacing of said tubes is such that the inside diameter measured in millimeters greater than 0.0125 w minus 5 where w is the full load mass flow entering said tubes measured in kilograms per second per meter squared.

19. An apparatus as in any one of claims 1–14: wherein at full load the frictional pressure drop through said vertical tubes is less than 4 times the static head of the fluid in said tubes.

20. A once-through type steam generator for sliding pressure operation in the subcritical pressure range, comprising: a furnace; vertical tubes lining the walls of said furnace around the periphery thereof, said tubes in parallel flow arrangement and continuous throughout the height of said furnace; internal flow agitating means located within said tubes throughout substantially the entire heated length thereof; a steam-water separating means; means for conveying fluid leaving said tubes to said separating means; a superheater; means for conveying steam from said separating means to said superheater; means for selectively directing substantially the entire flow of fluid leaving said tubes through said superheater; feedwater supply means; means for conveying feedwater to said tubes; means for passing a flow through said tubes exceeding the flow through said superheater during very low load operation of said steam generator; fixed means for apportioning flow to various of said vertical tubes in proportion to the predicted full load heat absorption of the various tubes; and the size and spacing of said vertical tubes being such that the mass flow of water entering said tubes at full load and measured in kilograms per second per meter squared is less than d+5 divided by 0.0125 where d is the inside diameter of the tube measured in millimeters.

21. A supercritical pressure once-through type steam generator for sliding pressure operation into the subcritical pressure range at reduced loads, comprising: control means for operating said steam generator at supercritical pressure at high loads and at subcritical pressure at low loads; a furnace; vertical tubes lining the walls of said furnace around the periphery thereof, said tubes in parallel flow arrangement and continuous throughout the height of said furnace; internal flow agitating means located within said tubes throughout substantially the entire heated length thereof; a steam-water separating means; means for conveying fluid leaving said tubes to said separating means; a superheater; means for conveying steam from said separating means to said superheater; means for selectively directing substantially the entire flow of fluid leaving said tubes through said superheater; feedwater supply means; means for conveying feedwater to said tubes; means for passing a flow through said tubes exceeding the flow through said superheater during very low load operation of said steam generator; fixed means for apportioning flow to various of said vertical tubes in proportion to the predicted full load heat absorption of the various tubes; and wherein at full load, the frictional pressure drop through said vertical tubes is less than 4 times the static head of the fluid in said tubes.

22. An apparatus as in claim 20 or 21 wherein said means for passing a flow comprises: means for conveying water from said steam separating means to said tubes; and pump means for recirculating water from said separating means through said tubes at low loads.

23. An apparatus as in claim 22: wherein said pump is sized to recirculate less than 50 percent of the full load flow.

24. An apparatus as in claim 23: wherein said internal flow agitating means comprises internal rifling within said vertical tubes.

25. An apparatus as in claim 24: wherein said pump is sized to recirculate less than 30 percent of the full load flow.

26. An apparatus as in claim 25: wherein said fixed means comprises orifices arranged to throttle the flow entering said vertical tubes.

27. An apparatus as in claim 22: wherein said internal flow agitating means comprises internal rifling within said vertical tubes.

28. An apparatus as in claim 27: wherein said fixed means comprises orifices arranged to throttle the flow entering said vertical tubes.

* * * * *